United States Patent [19]

Joyner et al.

[11] 4,241,671

[45] Dec. 30, 1980

[54] AIR-CURTAIN INCINERATOR FOR ENERGETIC MATERIALS

[75] Inventors: Taylor B. Joyner; Albert H. Lepie, both of Ridgecrest; Charles D. Stanifer, China Lake, all of Calif.

[73] Assignee: The United States of America as represented by the Secretary of the Navy, Washington, D.C.

[21] Appl. No.: 39,920

[22] Filed: May 17, 1979

[51] Int. Cl.[3] ..... F23N 5/18

[52] U.S. Cl. ..... 110/188; 110/235; 110/237; 236/15 BR

[58] Field of Search ..... 110/235, 237, 188, 189, 110/297, 309, 310, 313; 431/190, 37, 75, 76; 236/15 BB, 15 BR, 15 BD

[56] References Cited

U.S. PATENT DOCUMENTS

| | | | |
|---|---|---|---|
| 3,452,690 | 7/1969 | Tarbox et al. | 110/237 |
| 3,465,696 | 9/1969 | Amundsen | 110/190 |
| 3,483,832 | 12/1969 | Boll et al. | 110/238 |
| 3,592,150 | 7/1971 | Lanyou | 110/238 |
| 3,704,676 | 12/1972 | Davies et al. | 110/238 |
| 3,785,302 | 1/1974 | Davis | 110/215 |
| 3,797,414 | 3/1974 | Ahrend | 110/235 |
| 3,869,994 | 3/1975 | Berlichingen | 110/235 |
| 3,910,209 | 10/1975 | Albrecht et al. | 110/189 |
| 4,182,246 | 1/1980 | Lombana et al. | 110/188 |

*Primary Examiner*—Edward G. Favors
*Attorney, Agent, or Firm*—R. S. Sciascia; W. Thom Skeer; John H. Lynn

[57] ABSTRACT

An air-curtain incinerator for burning energetic materials. Both the volume of air and the angle at which air enters the fire box are remotely controllable. The combustion process is monitored, and the air volume and angle at which air enters the fire box are controlled to minimize the production of air pollutants by the combustion of energetic materials.

10 Claims, 3 Drawing Figures

AIR-CURTAIN INCINERATOR FOR ENERGETIC MATERIALS

BACKGROUND OF THE INVENTION

1. Field of the Invention

This invention pertains to incinerators. More particularly, this invention pertains to air-curtain incinerators for burning explosive or energetic materials.

2. Description of the Prior Art.

Conventional methods of disposing of contaminated waste, obsolete, or otherwise unwanted energetic materials, such as explosives and propellants, are open-field burning or detonation. These methods are not unacceptable from the standpoint of air quality control.

The air-curtain incinerator offers the possibility of reducing objectionable air-pollutants while maintaining the desirable features of safety and low-cost which open-field burning has provided. However, the conventional air-curtain incinerator is designed for the destruction of conventional wastes such as logging slash, tree stumps, construction debris, or combustible municiple wastes. For such wastes, the incinerator is normally operated in a continuous or semi-continuous fashion with the material periodically loaded into the hot incinerator. For these operations the conventional air-curtain incinerator provides a constant air flow directed into the flame at a fixed angle. Although adequate for conventional combustibles, the conventional air-curtain incinerator lacks the flexibility that research has shown to be desirable for destroying energetic materials on a batch basis. Research has revealed that in order to achieve optimum control of emissions, provision for variation of the volume of air flow and of the direction of air flow into the fire box of the incinerator is necessary. In view of the potential hazards associated with the incineration of energetic materials, control of the air flow and air angle should be accomplished using remote control devices.

SUMMARY OF THE INVENTION

The present invention has a blower which forces air through a pipe toward the fire box of the incinerator. A movable air inlet restriction plate controls the volume of air supplied to the incinerator. Air enters the fire box of the incinerator through a manifold having a plurality of nozzles. A reflector plate is mounted on the fire box in front of the manifold nozzles so that air entering the fire box reflects from the reflector plate. The reflector plate is rotatable to allow variation of the angle at which air enters the incinerator. The invention provides means for monitoring the volume of air supplied to the fire box, the angle at which air enters the fire box, and the combustion process.

DESCRIPTION OF THE PREFERRED EMBODIMENT

Figure 1:
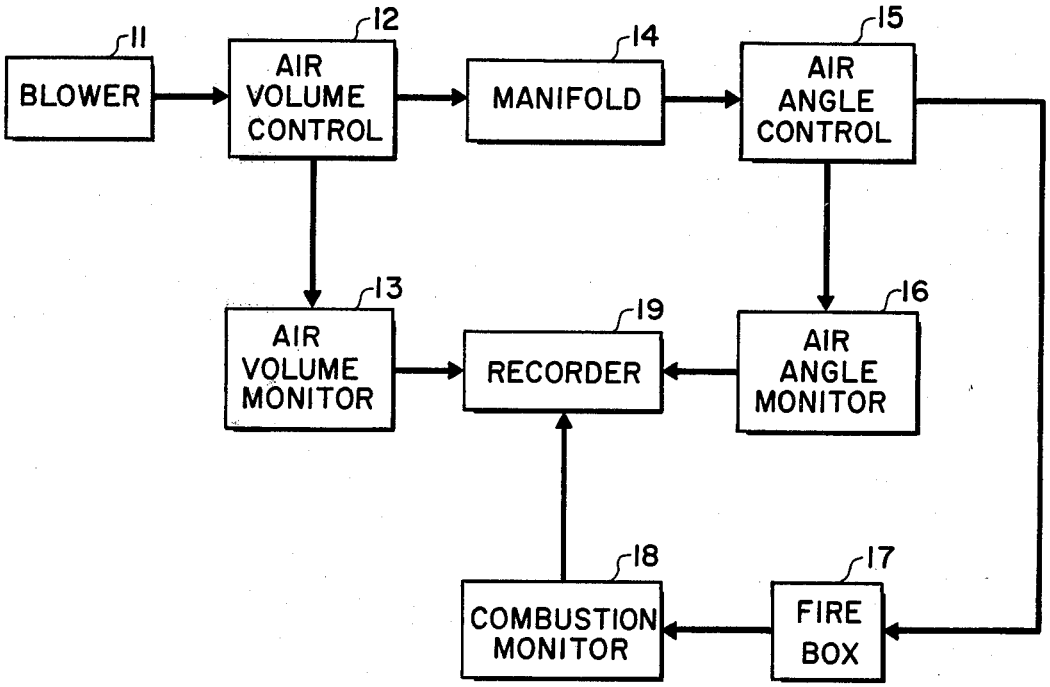
FIG. 1 is a block diagram of the invention.

Referring to FIG. 1, a blower 11 provides an air supply to a steel-lined fire box 17. An air volume control means 12, which may be an air inlet restriction plate whose position may be remotely controlled, is mounted between blower 11 and fire box 17. An air volume monitor means 13, which may be a potentiometer, is connected to air volume control means 12. Air enters fire box 17 through manifold 14; and the angle at which air enters fire box 17 is controlled by an air angle control means 15, which may be a reflector plate, mounted on fire box 17 so that air passing from manifold 14 reflects from air angle control means 15. An air angle monitor means 16, which may be a pontentiometer, is connected to air angle control means 15 for monitoring the angle at which air enters fire box 17. Smoke densities may be evaluated by a combustion monitor means 18, which may be a television system, photodiodes aimed through the smoke cloud using the sky as a reference, or by photography. Other pollutants may be sampled and analyzed by physical or chemical means. The outputs of air volume monitor means 13, air angle monitor means 16, and combustion monitor means 18 are recorded on a multi-channel recorder 19. Observation of the outputs of the various monitors during the burn allows an operator of the invention to adjust the air angle and air volume for maximum pollution abatement.

Figure 2:
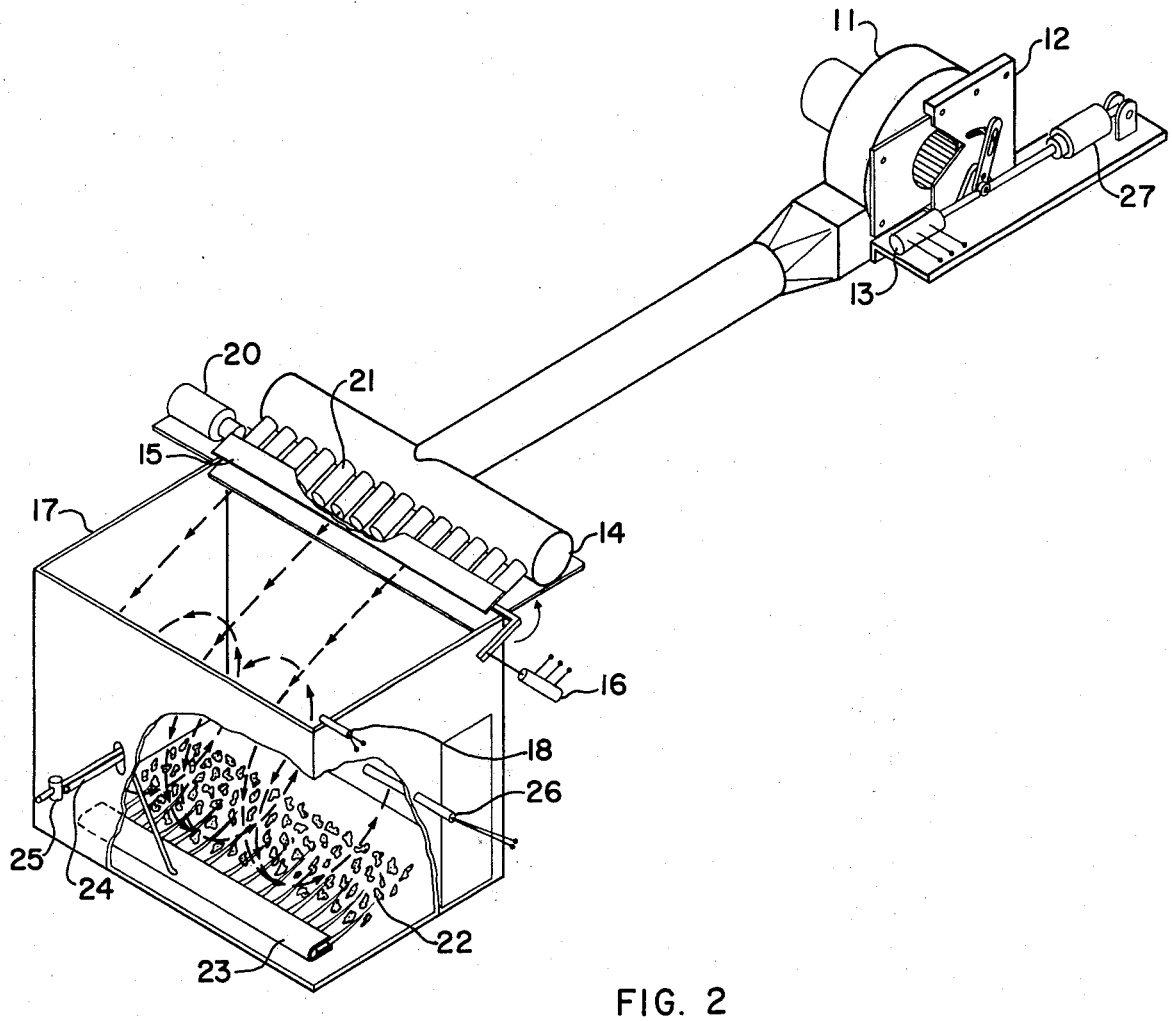
FIG. 2 is a pictorial representation of the essential components of the invention.

Referring to FIG. 2, structural details of the invention are illustrated. The position of restriction plate 12 is controlled by a high-torque motor 27, which may be remotely controlled, to adjust the air inlet opening to a desired size. Blower 11 supplies pressurized air to manifold 14, which has a plurality of nozzles 21 that direct air toward reflector plate 15 whose position is controlled by a motor 20.

A substance 22 to be burned is suitably placed in fire box 17. A conventional burner 23, having fuel supplied through a solenoid valve 25 and electrically ignited by an igniter 24, initiates the incineration process. The temperature of the combustion is monitored by a thermocouple 26.

Figure 3:
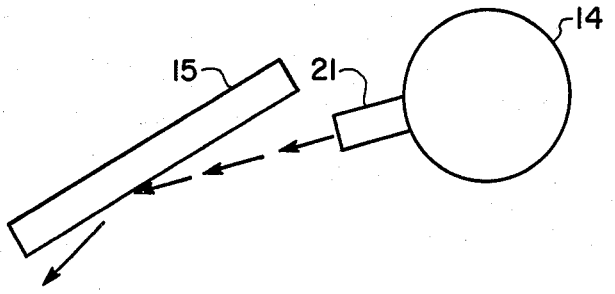
FIG. 3 illustrates reflection of air from the reflector plate.

Referring to FIG. 3, the angle at which air enters fire box 17 is determined by the position of reflector plate 15. The optimum angle for air to enter fire box 17 depends upon the volume and nature of the material to be incinerated. An operator of the incinerator adjusts the air volume and angle at which air enters fire box 17 to minimize the smoke density and to minimize the amount of other pollutants released by the combustion process.

What is claimed is:

1. An incinerator, comprising;

a fire box;

blower means for supplying air to said fire box connected thereto;

air volume control means connected to said blower means, for controlling the volume of air supplied to said fire box;

first monitor means for monitoring the volume of air supplied to said fire box connected to said air volume control means;

a manifold connected to said air volume control means for injecting air into said fire box, said manifold having a plurality of nozzles;

an air angle control means for controlling the angle at which air enters said fire box connected thereto;

second monitor means for monitoring the angle at which air enters said fire box connected to said air angle control means; and third monitor means for monitoring combustion connected to said fire box.

2. An incinerator according to claim 1 wherein said volume control means comprises a movable air inlet restriction plate.

3. An incinerator according to claim 1 wherein said first monitor means comprises a potentiometer.

4. An incinerator according to claim 1 wherein said third monitor means comprises a photodiode.

5. An incinerator according to claim 1 wherein said air angle control means comprises a movable reflector plate mounted on said fire box, said reflector plate positioned so that air flow from said plurality of nozzles reflects from said reflector plate into said fire box.

6. An incinerator according to claim 5 wherein said second monitor means comprises a potentiometer.

7. An incinerator according to claim 5 wherein said volume control means comprises a movable air inlet restriction plate.

8. An incinerator according to claim 5 wherein said first monitor means comprises a potentiometer.

9. An incinerator according to claim 5 wherein said means from monitoring combustion comprises a photodiode.

10. An incinerator, comprising:

a fire box;

a blower for supplying air to said fire box;

a movable air inlet restriction plate attached to said blower;

a potentiometer for monitoring the volume of air supplied to said fire box connected to said movable air inlet restriction plate;

a manifold connected to said blower for injecting air into said fire box, said manifold having a plurality of nozzles;

a movable reflector plate mounted on said fire box, said reflector plate positioned so that air flow from said plurality of nozzles reflects from said reflector plate into said fire box;

a second potentiometer connected to said reflector plate for monitoring the angle at which air enters said fire box; and a photodiode connected to said fire box for monitoring the combustion process therein.

* * * * *